US008016443B2

(12) United States Patent
Falicoff et al.

(10) Patent No.: US 8,016,443 B2
(45) Date of Patent: Sep. 13, 2011

(54) REMOTE-PHOSPHOR LED DOWNLIGHT

(75) Inventors: Waqidi Falicoff, Stevenson Ranch, CA (US); William A. Parkyn, Lomita, CA (US)

(73) Assignee: Light Prescriptions Innovators, LLC, Altadena, CA (US)

( * ) Notice: Subject to any disclaimer, the term of this patent is extended or adjusted under 35 U.S.C. 154(b) by 320 days.

(21) Appl. No.: 12/387,341

(22) Filed: May 1, 2009

(65) Prior Publication Data

US 2009/0273918 A1 Nov. 5, 2009

Related U.S. Application Data

(60) Provisional application No. 61/126,366, filed on May 2, 2008, provisional application No. 61/134,481, filed on Jul. 10, 2008.

(51) Int. Cl.
*F21V 33/00* (2006.01)

(52) U.S. Cl. ..... 362/84; 362/310; 362/296.01

(58) Field of Classification Search ..... 362/296.1, 362/306, 310, 84
See application file for complete search history.

(56) References Cited

U.S. PATENT DOCUMENTS

| | | | | |
|---|---|---|---|---|
| 6,841,804 | B1 * | 1/2005 | Chen et al. | 257/98 |
| 7,357,550 | B2 | 4/2008 | Li | 362/555 |
| 2004/0129945 | A1 * | 7/2004 | Uemura | 257/98 |
| 2005/0243570 | A1 | 11/2005 | Chaves et al. | 362/551 |
| 2006/0227302 | A1 | 10/2006 | Harbers et al. | 353/94 |
| 2007/0024191 | A1 * | 2/2007 | Chen et al. | 313/512 |
| 2007/0081336 | A1 | 4/2007 | Bierhuizen et al. | 362/293 |
| 2007/0297179 | A1 * | 12/2007 | Leung et al. | 362/296 |
| 2008/0142816 | A1 * | 6/2008 | Bierhuizen et al. | 257/82 |

* cited by examiner

*Primary Examiner* — Laura Tso
(74) *Attorney, Agent, or Firm* — Drinker Biddle & Reath, LLP

(57) ABSTRACT

An embodiment of a collimating downlight has front-mounted blue LED chips facing upwards, having a heat sink on the back of the LED chips exposed in ambient air. The LED chips are mounted in a collimator that sends their blue light to a remote phosphor situated near the top of the downlight can. Surrounding the remote phosphor is a downward-facing reflector that forms a beam from its stimulated emission and reflected blue light. The phosphor thickness and composition can be adjusted to give a desired color temperature.

20 Claims, 5 Drawing Sheets

REMOTE-PHOSPHOR LED DOWNLIGHT

CROSS REFERENCE TO RELATED APPLICATION

This application claims benefit of U.S. Provisional Patent Applications No. 61/126,366, filed May 2, 2008, and No. 61,134,481, filed Jul. 10, 2008, which are incorporated herein by reference in their entirety.

BACKGROUND OF THE INVENTION

Downlights are lighting fixtures mounted in a ceiling for illumination directly below them. These ubiquitous luminaires generally comprise an incandescent spotlight mounted within a can. The can is typically closed except at the bottom, so any hot air becomes trapped within the can. Even in the rare cases when heat is transmitted through the can to a heat sink or heat exchanger on the outside of the can, the heat exchanger is typically in stagnant air within a false ceiling, and is not very effective. In most cases, not only is there no heat exchanger, the can is actually insulated to prevent heat from being delivered into the space within the false ceiling. Since incandescent bulbs operate hot anyway, they are not thermally bothered by the can being a trap for hot air. It would be highly desirable to replace the light bulbs with lamps using light-emitting diodes (LEDs), which are more efficient. A white LED system, using blue LEDs combined with yellow phosphor, would be suitable.

LEDs, however, are sensitive to excessive temperatures and thus find downlights to be a more difficult lighting application than anticipated. This is because their heat cannot safely be dissipated passively into the stagnant hot air of the typical downlight can. This typically limits the total wattage that can be handled in a solid state LED downlight to a maximum power of approximately 4 Watts. This limit can only be overcome if the can is dramatically widened to aid in cooling for the sake of heat management, a severe limitation on the situations in which the LED downlight can be used. Furthermore, the best commercially available 4 Watt LED sources have an efficacy of 60 lumens per Watt including driver losses. This limits the solid state downlight to a flux of only approximately 250 lumens. A flux output of 600 to 1000 lumens is desirable for a downlight, and it is desirable for the downlight to be able to operate in a standard size, typically 4"-6" (10 to 15 cm) diameter ceiling can. This is achievable for an LED or comparable solid-state downlight if the heat management can handle a minimum of 10 Watts.

SUMMARY OF THE INVENTION

One embodiment of the present invention provides a luminaire comprising one or more blue LED chips, collimating apparatus operating upon the output light of said chips, a phosphor patch situated at a distance from said LED chips such that said collimator illuminates said phosphor patch, and a beam-forming reflector surrounding said phosphor patch.

The aforementioned thermal limitation of LEDs is overcome in the present application by separating the blue LED and the yellow phosphor in white LEDs. Then the heat-producing LEDs can be situated at the front (bottom) of the downlight, facing backwards (upwards, into the can), so that only the remote phosphor need be at the back (top). This allows the LEDs to have a heat sink that is located at the open (bottom end) face of the can or, if needed, just outside the can. It also allows for an active cooling device to be attached to the can instead of, or in addition to, a passive heatsink. An example of a commercially available active cooling device suitable for this purpose is the Nuventix Synjet cooler, which can easily handle 15 to 20 Watts.

An embodiment of a luminaire comprises one or more blue LED chips, a collimator operative on the emitted light of said chips to produce collimated light, a phosphor situated at a distance from the LED chips such that the collimated light illuminates the phosphor, and a beam-forming reflector surrounding the phosphor and arranged to produce an output beam of light from the phosphor past the LED chips.

Another embodiment of a luminaire comprises a housing with an open end and a closed end, a phosphor patch in the closed end of the housing, a light source spaced from the phosphor patch in the direction from the closed end of the housing to the open end of the housing, and arranged to emit light so as to illuminate the phosphor patch, wherein light from the phosphor patch is emitted through the open end of the housing past the light source.

A further embodiment of a luminaire comprises a shroud having an open end and a closed end, an opaque reflector in the closed end of the shroud, a phosphor patch in the closed end of the shroud, between the opaque reflector and the closed end of the shroud, and a light source in the open end of the shroud, operative to direct onto the phosphor patch light of a frequency effective to excite the phosphor patch, wherein light from the phosphor patch exits through the open end of the shroud past the light source.

In an embodiment, the beam-forming reflector may produce an output beam centered on an axis from a center of the phosphor or phosphor patch through a center of the LED chips or other light source. The near field beam may then be annular, because the light source creates a shadow in the middle, but by shaping the beam to include converging rays, the field can close at the center further from the luminaire.

In an embodiment, the beam-forming or primary reflector may comprise a conicoidal reflector having a narrow end encircling the phosphor patch, and may further comprise a cylindrical reflector extending from a wide end of the conicoidal reflector to the open end of the luminaire.

In an embodiment, the light source may comprise a collimator operative on the output light of the light source to illuminate the phosphor patch with light from the light source, and preferably to illuminate substantially the whole phosphor patch with substantially all the light from the light source, either directly or by reflection from the output beam-forming reflector.

In an embodiment, the luminaire may comprise an inner cylinder surrounding the collimator, the exterior of the cylinder being a specular mirror or other reflector. Any spider or other structure supporting or carrying power or control lines to the light source may also be reflective.

In an embodiment, the luminaire may comprise an opaque reflector behind the phosphor patch at the closed end of the housing. The phosphor patch may then cover only part of the area of the reflector, for example, as a pattern of phosphor dots, or a pattern of phosphor with holes in it.

In an embodiment, the phosphor patch may be cooled by a heat sink situated on the opposite side of the opaque reflector from a side facing the light source.

In an embodiment, the light source may comprise at least one blue LED. The emitted light may then comprise blue light from the blue LED reflected at the phosphor patch and light produced by conversion of the blue light from the blue LED by the phosphor patch. The emitted light may then be white or whitish. The CRI and/or color temperature of the white light may be adjusted by using additional or secondary LEDs of a different color, for example, red or a longer-wavelength blue.

Any additional LEDs may be included in the light engine of the primary light source, or may be mounted in the phosphor patch.

In an embodiment where the phosphor patch is not a continuous layer of phosphor, secondary LEDs may be mounted in parts of the reflector that are not coated with phosphor.

In an embodiment, the luminaire may have a tunable color temperature. Where the luminaire has LEDs or other light sources of more than one color, the tuning may be provided by separately controlling the intensities of LEDs of different colors.

In an embodiment, the LED chip or other primary light source may be cooled by a heat sink situated on a side of said at least one LED chip opposite from a side to which said LED chip emits light. In the case of a downlight, the heat sink may be arranged so that when the downlight is installed in a ceiling the heat sink will project into the room being lit, below the visible ceiling.

For a preferred embodiment, directly substituting for a typical 2 to 5 inch (50 to 125 mm) diameter downlight producing a beam of 30-40° half angle, the remote phosphor patch will be much larger (typically an inch or two, 25 to 50 mm, across) than the LED source, (typically a chip 1 mm across or a small array of such chips). Thus, the heat load of the remote phosphor is typically not a problem, because the large area of the phosphor results in a low concentration of heat energy to be dissipated. There is typically a secondary optic on the blue LED, so that all its light will shine only on the remote phosphor at the back (top) of the downlight. The most practical secondary optic is a cone-sphere combination, because a conical reflector can use high-reflectivity films manufactured flat. The conical reflector is oriented with its open smaller end downwards, with the LED light source simply placed within the small lower opening of the cone so that all the light emission from the LED is captured by the cone and reflected upwards.

In the cone-sphere embodiment, a plano-convex lens entirely covers the cone's large upper opening and sends all the LED's blue light to the remote phosphor or near enough to it that a primary reflector on the inside of the can will redirect onto the phosphor any rays that do not reach the phosphor directly. The relatively large remote phosphor that the blue LED excites will have relatively low luminance as compared to much smaller conventional white LEDs, eliminating or substantially reducing any glare factor. The heat sink for the blue LEDs can be located down low, exposed to the ambient air below the visible ceiling, enabling adequate cooling even for a 10-20 Watt blue LED package. Such power levels are too much to be easily accommodated in an installation in the top of a sealed hot can, closed to outside air, even with a fan. With the current proposal, only the phosphor heats the interior of the can, so the interior of the can becomes less hot than if the LEDs were in the top of the can. In addition, only the phosphor is in the top of the can, and the phosphor is far less vulnerable to heat damage than the LEDs themselves.

It is also desirable to have a solid state downlight with a high CRI of 92 or better, with a color temperature ranging from 2500 to 4000° K. This can be achieved using currently available phosphors in conjunction with blue LEDs. An alternative preferred embodiment uses a combination of a blue LED chip with a red LED chip, configured in a two-dimensional array at the base of the cone. In order to achieve high uniformity of both red and blue light on the phosphor, homogenizing lenslets can be added to the inner flat face of the plano-convex lens. Alternatively, a holographic or other shaping diffuser can be used after the lens. By individually tuning the currents supplied to the red and blue LEDs, a wide range of color temperatures can be achieved, all with very high CRI.

BRIEF DESCRIPTION OF THE DRAWINGS

The above and other aspects, features and advantages of the present invention will be apparent from the following more particular description thereof, presented in conjunction with the following drawings wherein.

DETAILED DESCRIPTION OF THE PREFERRED EMBODIMENTS

A better understanding of various features and advantages of the present invention will be obtained by reference to the following detailed description of embodiments of the invention and accompanying drawings, which set forth illustrative embodiments in which various principles of the invention are utilized.

A downlight is a ceiling-mounted luminaire shining downwards with a restricted output angle. A downlight is generally recessed in a can from 4-6" (100-150 mm) in diameter and 6" (150 mm) deep. In the case of downlights intended for use in high ceilings, the output angle of the downlight is usually defined directly in degrees, but for ordinary ceilings there is frequently a zone of desired illumination, such as a tabletop. A good reflector for defined angles is the compound parabolic concentrator (CPC), while for defined target zones the compound elliptical concentrator (CEC) may be preferred. Since either one can be used as a primary reflector in the present invention, the inclusive term 'ideal reflector' will be used hereinafter to include both CECs and CPCs. Their shapes are so visually similar as to make their differences indiscernible in the Figures herein.

Figure 1:
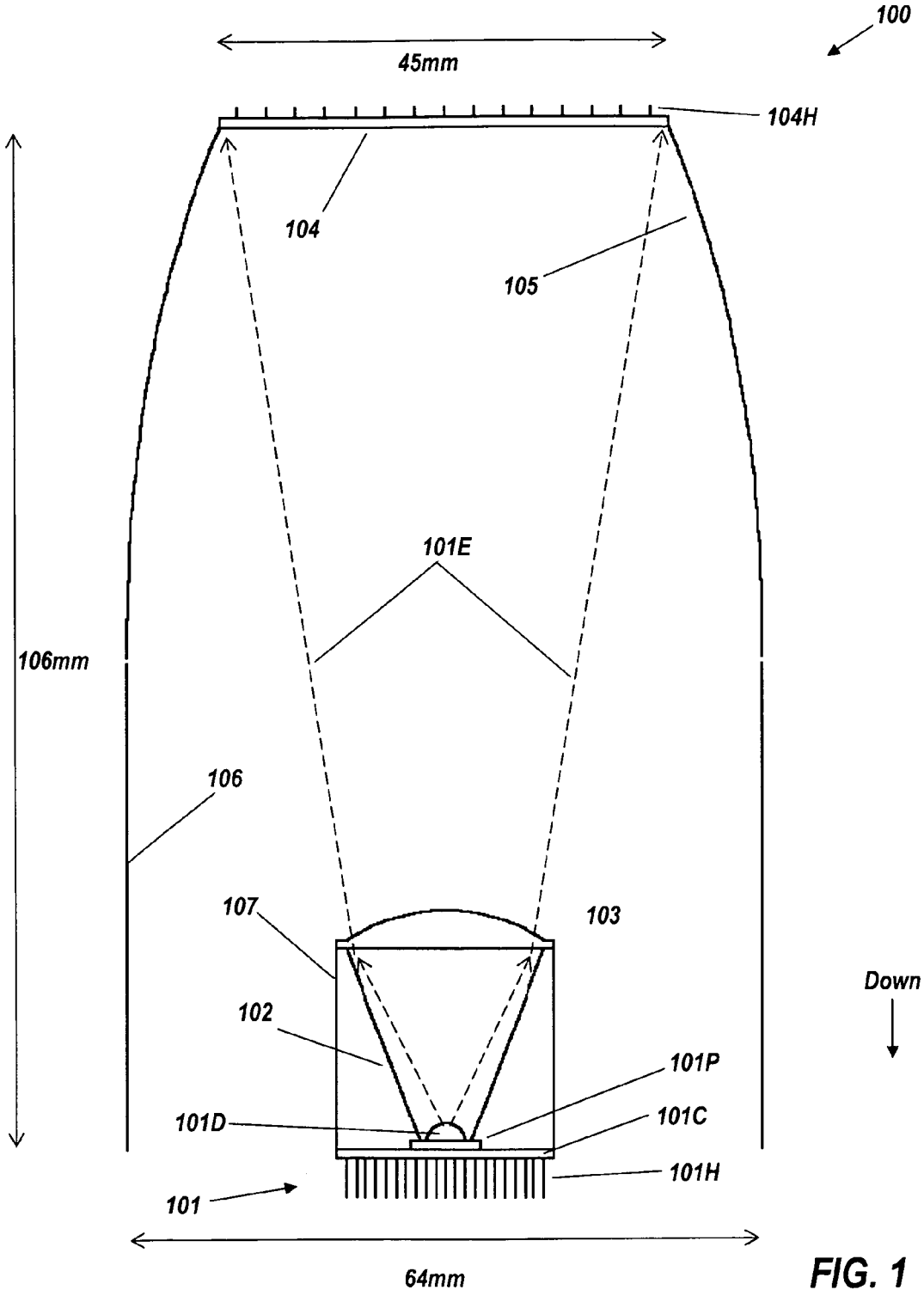
FIG. 1 shows a remote-phosphor luminaire with a 45° design angle.

FIG. 1 is a cross-section view of a first embodiment of a remote-phosphor LED luminaire 100, comprising light source 101 (comprising transparent dome 101D from which emission 101E originates, LED package 101P, circuit board 101P, and rear heat exchanger 101H), reflective cone 102, plano-convex lens 103, remote phosphor 104, and ideal beam-forming reflector 105. Cylindrical shroud 106 extends downward from reflector 105, to surround cone 102, and has the same reflective coating as reflector 105 to ensure that rays encountering it will stay within the output beam. To ease understanding of the drawing, cylindrical shroud 106 is drawn in FIG. 1 as artificially separated from the profile of reflector 105. However, in a practical embodiment there is no gap between them, and they may be manufactured in a single piece. Cylindrical outer reflector 107 surrounding cone 102 ensures that rays from phosphor 104 or reflector 105, 106 encountering reflector 107 will stay within the output beam. The shroud and reflector 105, 106 may serve as a ceiling can in place of a conventional ceiling can, or may be placed within an existing ceiling can.

Reflector 105 is a CPC with a 45° output angle when acting as a collimator for the emitted beam. Reflector 105 acting as a concentrator will accept any blue light from LED 101 as long as the light rays are within that angle of the central axis, and convey such light to remote phosphor 104. Functionally, the combination of cone 102 and lens 103 could be replaced by any other collimator that efficiently collects the light output of LED 101 and collimates that light to produce a beam no wider in angle than ±45°. FIG. 1 shows luminaire 100 as being 106 mm high, 64 mm wide across the open mouth, and 45 mm wide across the phosphor 104 and heat sink 104H. Dotted lines 101*e* denote example rays of blue light terminating directly on remote phosphor 104. For the sake of clarity, the corresponding emission of the phosphor 104 is not shown in FIG. 1. (Rays emitted from the phosphor are shown in FIG. 3, discussed below.)

Figure 3:
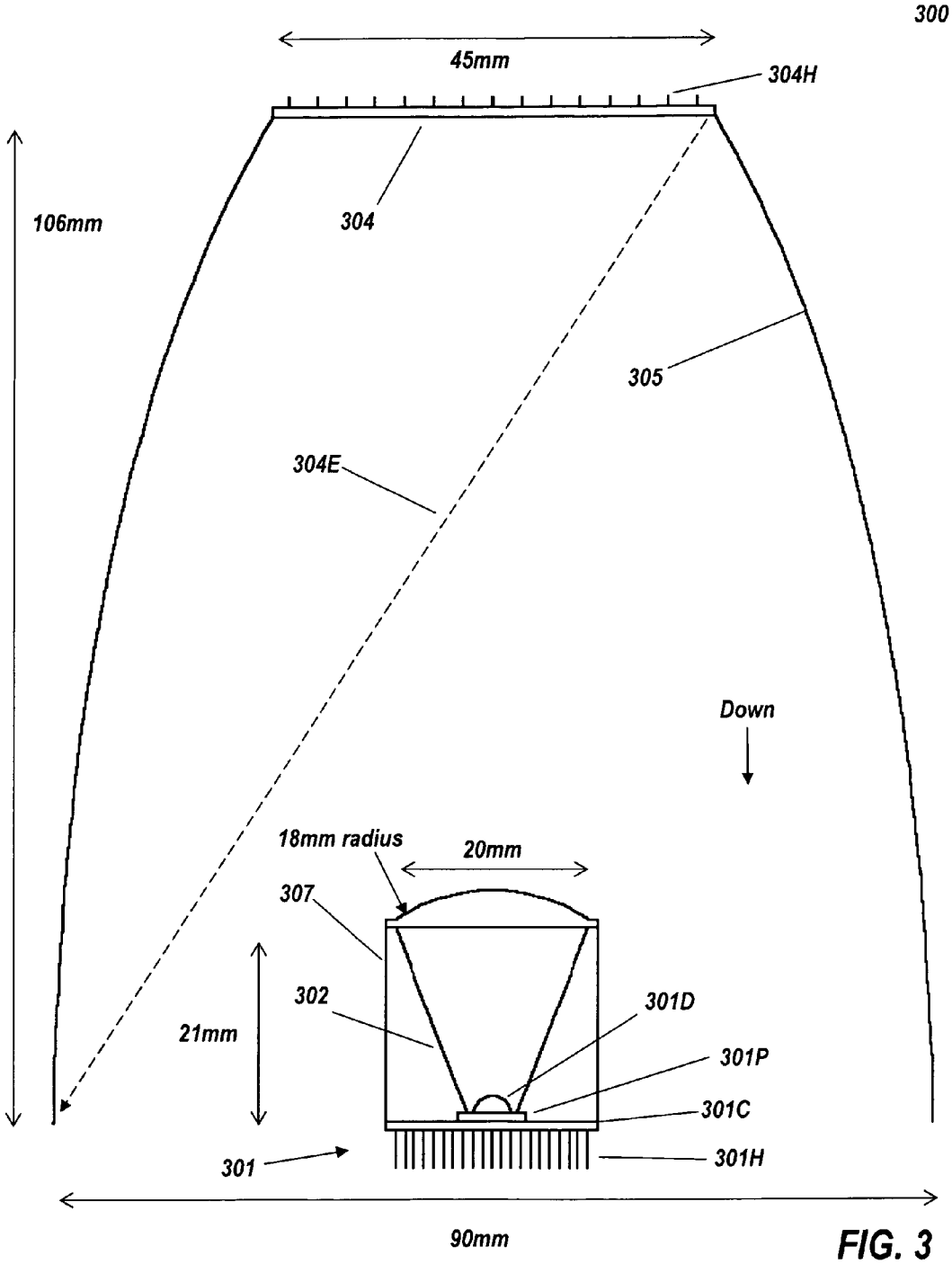
FIG. 3 shows a remote-phosphor luminaire with a 30° design angle.

Likewise, the dimensions of the LED optics, which are identical in FIGS. 1 and 3, are shown only in FIG. 3. In both designs the diameter of the opening at the base (narrow end) of the reflective cone 102 and 302 is 2.5 mm. This is large enough to accommodate a square LED chip that is larger than 1 mm on its side, as long as the LED has no dome. In order to handle a 4 chip array, with each LED having a rated power output of 2 Watts, the system would be scaled slightly larger. Several manufactures make surface-mounted LEDs that have no dome, just a flat window over the chip. One such device is the so-called OSTAR LED by Osram Opto of Regensburg, Germany, which has an active emitting area of 2.1×2.1 mm.

The thickness and composition of remote phosphor 104 of FIG. 1 may be adjusted so that the light it emits is a calorimetrically proper mixture of photostimulated yellow emission and scattered blue light. If the phosphor's composition was highly absorptive, little or no blue light would survive its passage through the phosphor, and its total emission would not be white. Experimental tests of various compositions are used establish the proper thickness of the remote phosphor. The skilled person can easily determine a suitable phosphor layer for a desired or available phosphor composition. At the rear of the remote phosphor, a highly reflective surface (not shown in detail) is employed to ensure against rear losses of yellow light emitted upwards from the phosphor, and of blue light that passes through the phosphor layer without being absorbed and converted. Because the unconverted blue light is reflected and passes through the phosphor twice, a phosphor layer only half as thick as in a transmissive configuration may be used. The back reflector can be either specular or diffusive and should also be designed to withstand the operating temperature of the phosphor, and to conduct the thermal output of the phosphor to the heat-sink 104H. The thermal loads from the phosphor are approximately 10% of the total wattage of the system, so for a 10 Watt system the load that needs to be handled by the reflector and its associated heat sink 104*h* is on the order of 1 Watt. Both DuPont and W. L. Gore supply commercially white diffuse films with a reflectivity of at least 98% that are suitable for this purpose. Those films can be applied on a metal substrate, allowing thermal conduction from the phosphor 104 to the heatsink 104H. Where the phosphor 104 can be cooled by radiation, conduction, and convection from the front surface, so that heat sink 104H is not required, and therefore thermal conduction through the reflector is not required, an opaque white ceramic or plastic reflector may be used.

Remote phosphor 104 of FIG. 1 may be either a continuous layer or a discontinuous layer. If the layer is discontinuous, it may comprise a pattern of phosphor dots with spaces between them, as shown in FIG. 6B, or of a phosphor layer with a pattern of holes in it as shown in FIG. 6C. A continuous layer is simpler to apply. However, for a white light output that comprises a mixture of blue LED radiation converted to yellow light at the phosphor and blue LED light reflected without being converted, if the phosphor layer is continuous then the color balance of the light output is sensitive to the thickness of the phosphor layer. The thicker the phosphor, the higher the proportion of the blue LED light that is converted to yellow. The correct thickness will depend on the properties of the specific phosphor used, including the phosphor species and its concentration, and the optical properties of any medium containing the phosphor, as well as the desired output color balance. With a discontinuous phosphor layer, the thickness of the phosphor can be sufficient to convert substantially all of the blue LED light entering it, and the color balance (and thence color temperature) can then be controlled by adjusting the proportion of the reflector that is covered by phosphor 104. With a discontinuous phosphor, the reflector should be diffuse rather than specular.

As shown by the arrow marked "Down" in FIG. 1, the luminaire 100 is typically mounted in a ceiling with its central axis vertical and its open end, through which the white output beam emerges, downwards. The luminaire 100 can, of course, be used in other orientations, and will typically be stored and shipped in other orientations. However, the separation of the phosphor 104 from the LED 101 is typically most advantageous in the orientation shown, in which convection results in hot air being trapped inside the primary reflector 106, 105, and the back reflector and heat sink 104*h*.

Figure 2:
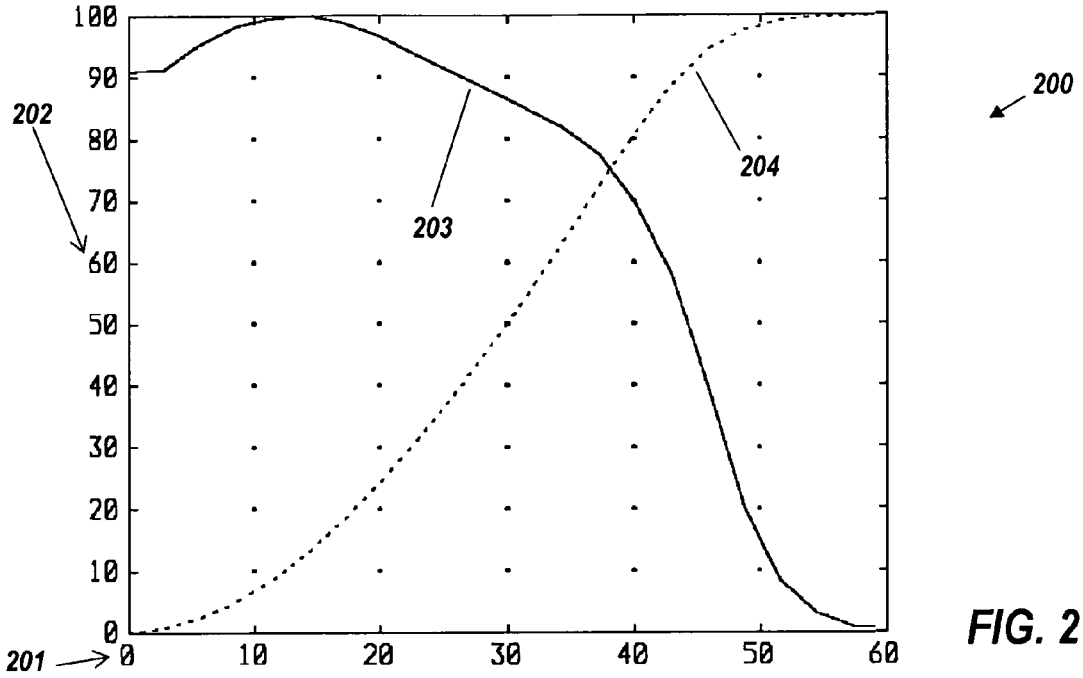
FIG. 2 shows the far-field intensity of same.

FIG. 2 shows the far-field performance of luminaire 100 of FIG. 1. Graph 200 has abscissa 201 indicating half-angle from 0 (on axis, normally vertically downwards for a ceiling downlight) to 60° off-axis, and ordinate 202, indicating relative strength in percent of peak value. Solid curve 203 indicates far-field intensity, and dotted curve 204 indicates its cumulative integral, also known as "encircled flux." Intensity falls to half maximum at the 45° design angle of the reflector. Half of the entire flux of the beam is within ±30°, and 90% is within the design angle of 45°, a strong indication of an effective system.

FIG. 3 is a cross-section view of a second embodiment of a remote-phosphor LED downlight. FIG. 3 shows luminaire 300, comprising blue light source 301 (comprising transparent dome 301D, LED package 301P, and rear heat exchanger 301H), conical reflector 302, plano-convex lens 303, remote phosphor 304, and ideal reflector 305, a slightly truncated CPC with a 30° acceptance/output angle. As shown in FIG. 3, cone frustum 302 has an axial length of 21 mm. Lens 303 and the wide end of cone 302 have a diameter of 20 mm. Cone 302 and lens 303 could be replaced by any suitable collimator that produces an output beam no wider in angle than ±30°. Dotted line 304E denotes the emission of remote phosphor 304, confined by reflector 305 to ±30°. Narrower output angles, for example, down to ±20°, are equally feasible if greater overall depth and width are allowed. As shown in FIG. 3, luminaire 300 is 106 mm high, 90 mm wide across the output end, and 45 mm wide across the phosphor end.

Figure 4:
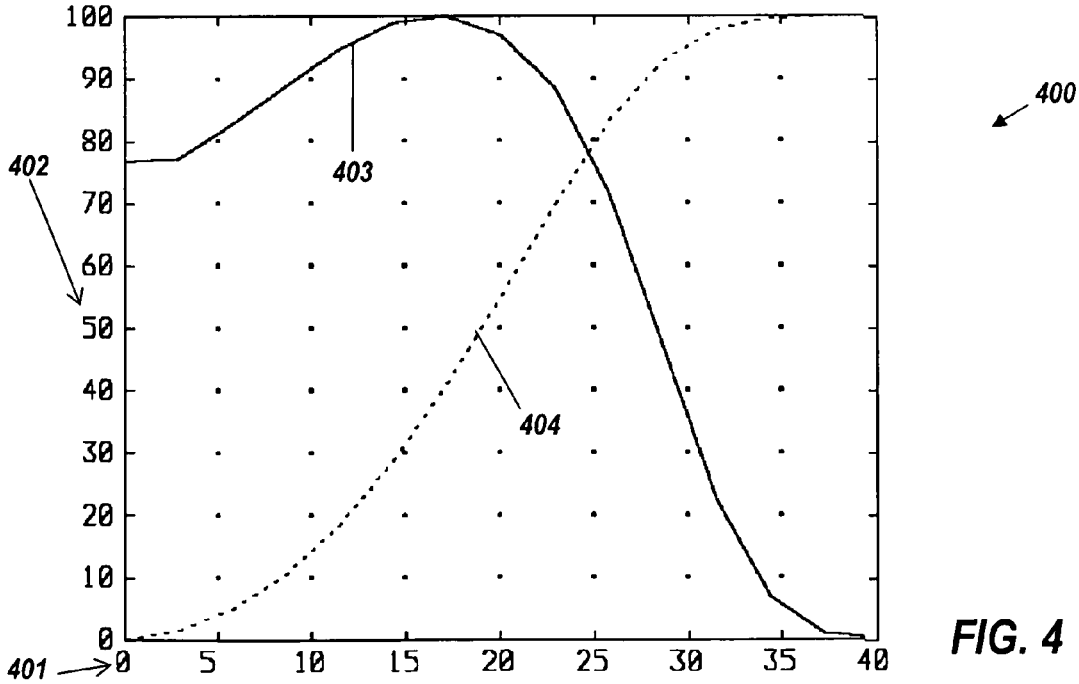
FIG. 4 shows the far-field intensity of same.

FIG. 4 shows the far-field performance of luminaire 300 of FIG. 3. Graph 400 has abscissa 401, which indicates angular position extending from 0° (on axis) to 40° off-axis, and ordinate 402, which indicates relative strength in percent of maximum. Solid curve 403 indicates far-field intensity, and dotted curve 404 indicates its cumulative integral. Intensity falls to half at 28°, just under the 30° design angle of the reflector. Half of the entire flux of the beam is within ±19°, and 95% is within the design angle of 30°. The central (on-axis) dip of the intensity curve in FIG. 3 is due to blockage by lens 303 of FIG. 3. Light going into lens 303 will be sent to LED 301, which typically will reflect 70% of the light back upwards, so that the light will be returned to the remote phosphor. Returning light from LED 301 to phosphor 304 improves the efficiency of the luminaire, but does not change the central dip of curve 403 of FIG. 4.

It can be seen from these two preferred embodiments 100 and 300 that the general design of the present luminaire is highly adaptable to a wide variety of beam patterns and a wide range of sizes and power outputs. Thus, the presently proposed luminaires are suitable for installation within the challenging thermal environment of commercial downlights. Not shown in the somewhat schematic FIGS. 1 and 3 are the requisite structural support for the central light engine 101, 102, 103, 107 or 301, 302, 303, 307 and the feed for delivery of electrical power thereto. The design of both of structural support and power feed allows so much freedom that aesthetic criteria may predominate. See, for example, spider 502 in FIG. 5. A primary motivation of the present luminaire was to get the heat-producing LED close to the ambient air below the downlight. Thus it is expected that the heat exchangers 101H, 301H depicted herein would enjoy convective access to that air.

The heat sink 104H, 304H for the remote phosphor 104, 304, is typically in stagnant air at the top of the downlight can, but the heat load from the phosphor is only about a third of the LED's optical output power, which in turn is only about a third of the electrical input. A phosphor's heat load will only be about one-seventh the heat load of the LED itself. This heat is from the blue light that is absorbed but does not cause fluorescence (sub-unity quantum efficiency, 80-90%) and from the lower energy of the photons of stimulated yellow light. The yellow-to-blue energy ratio, called the Stokes factor, is simply the ratio of the blue wavelength to the mean phosphor wavelength, typically about 80%. At 90% quantum efficiency, 10% of the blue light becomes heat, as well as 20% of the energy in the converted blue light, for a total heat load of 28% of the blue flux. The best LEDs currently commercially available convert about a third of their electrical power into light, so that the phosphor's heat load is about 10% of the electrical power, while the LED's heat load is ⅔ of the electrical power, giving a phosphor heat load of only one sixth that of the LED, and spread over far more area.

The heat sink 104*h*, 304*h* may be omitted if it is not needed. In many cases the removal of heat by radiation and conduction from the front of the phosphor 104, 304 to the air within the luminaire 100, 300 will be sufficient when combined with convection driven by the concentrated heat of the LED light engine 101, 301. In other cases, a thermal bridge from the phosphor 104, 304 to the primary reflector 105, 106, 305, which typically will be a metal shell acting as a heat sink, will be sufficient. The bridge may be provided by an aluminum or other metal substrate behind the phosphor 104, 304 that is continuous with the metal substrate of the primary reflector. In still other cases, a thermal bridge may be provided from the back of the phosphor 104, 304 to the can (not shown) within which the luminaire is installed.

Figure 5:
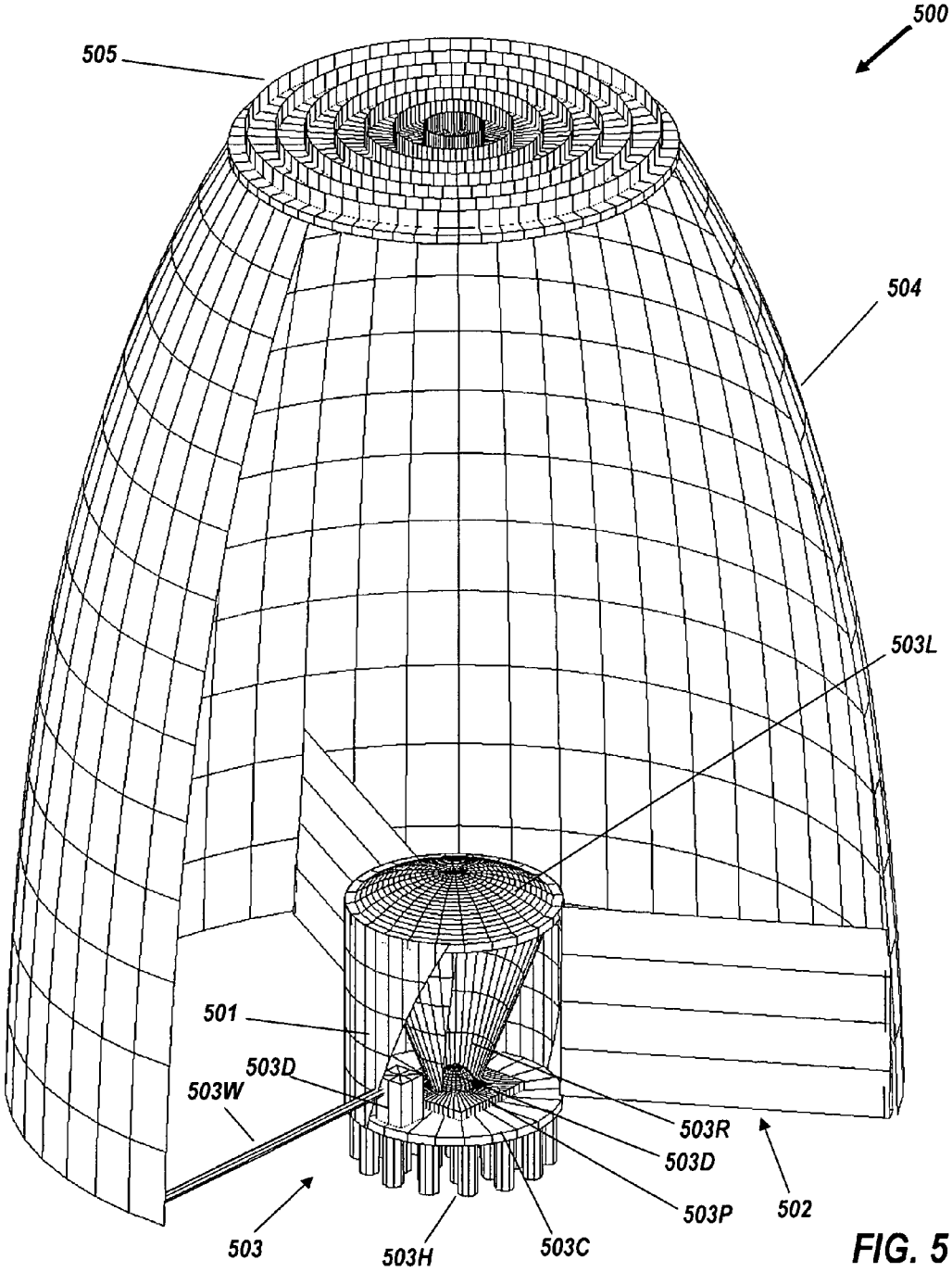
FIG. 5 shows a perspective view of a remote-phosphor luminaire with its heat sink and spider.

FIG. 5 shows a perspective cutaway view of a third embodiment, of a luminaire 500 with some of its key components as it would be seen from below. Remote-phosphor luminaire 500 comprises an outer cylindrical shroud 501, the interior surface of which acts as a reflector, and spider 502 supporting the light engine 503. The light engine 503 comprises conical reflector 503R, plano-convex lens 503L, transparent dome 503D, multi-chip LED package 503P, circuit board 503C, driver module 503D, power wire 503W, and multi-rod heat sink 503H on the underside of the light engine, which is encased in an exterior cylindrical reflector 504. External CPC 504 holds spider 502 and remote phosphor (not shown) with its cylinder-finned heat exchanger 505.

Spider 502 has internal features on one or more of its three vanes (two shown) to enclose the wiring 503W. The arms of spider 502 are preferably sharp-edged on the edge towards the remote phosphor 104, 304 and coated with high-reflectivity material. Light falling on the spider arms is then almost all merely deflected slightly, and not lost. The spider 502 can be thermally connected to the shroud 501, the heat sink 503, the base holding the LED array (not shown) and cylindrical reflector 504. One or more vanes of the spider 502 may include a heat pipe. All the surface area of these components can help with the thermal management of the LEDs. In addition, thermal management features can be added to cylindrical shroud 501 at its base (not shown).

As an alternative to spider 502 the LED light engine may be mounted on a transparent structure, for example, a glass disk. The disk would prevent hot air from heat sink 503 from entering the can, but would prevent the formation of the convection loop that in the embodiments previously described cools phosphor 104, 304 and cylindrical reflector 504 by carrying hot air from inside shroud 501 down into the room. A spider 502 designed to occlude only a small part of the exit aperture is therefore preferred in most cases.

The optical design of the present luminaires leads to the remote phosphor being far larger than the LED chips, which incidentally results in a lower phosphor-luminance level, more gentle to the eye. This larger area and lower heat flux result in a much easier cooling task. While the placement of the remote phosphor at the top of a closed can will indeed result in an elevated operating temperature for the phosphor, that temperature can still be far below what the phosphor in a conventional white LED typically experiences.

Figure 6:
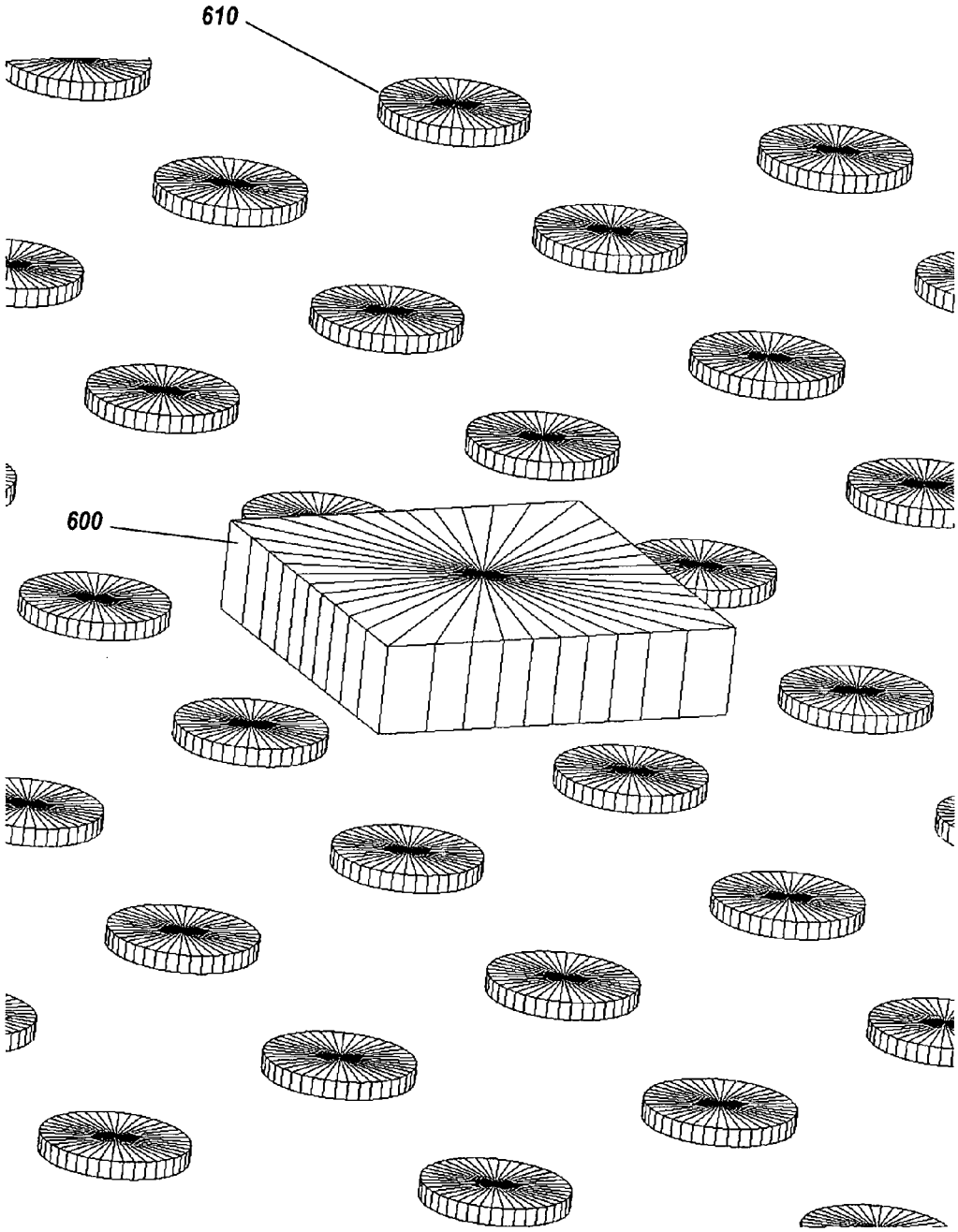
FIG. 6 shows a red LED chip surrounded by phosphor dots.

As was previously mentioned, it is possible to achieve high CRI using blue LEDs with a "warm" phosphor. However, there may be an advantage to using a cooler phosphor and combining this with the output of red LEDs, for example, around 625 nm peak emissivity. One advantage is that, because the Stokes loss in the phosphor is proportional to the ratio of the absorbed and emitted frequencies, the red phosphor output has the lowest efficiency, with about ⅓ of the blue light being dissipated as heat in the phosphor conversion. The red LEDs may be mounted before the phosphor patch is deposited, so that their light is spread out somewhat. FIG. 6 is a closeup perspective view of red LED 600 surrounded by phosphor dots 610, which are easier to illustrate with line drawings than a large patch. The heat output from a red LED, however, is still greater than the heat output by converting blue light at the phosphor for the same amount of red light produced. It is therefore preferred in the present luminaires to mount the red LEDs as part of the main LED light engine 101 or 301.

Alternatively, or in addition, relatively long-wave blue LEDs may be used directly to boost the amount of visible blue light emitted. For example, primary blue LEDs with a peak emissivity in the 410-460 nm range, such as 440 nm, may be used to excite the phosphor 104, 304. However, the blue light from the primary LEDs is too short in wavelength to have much visible luminance, and auxiliary blue LEDs with a peak emissivity around 490 nm may be used directly for additional visible blue light.

The use of red LEDs and/or auxiliary blue LEDs makes possible a downlight that has a white output of tunable color temperature, if the different colors of LED are separately driven by independently variable drivers. Tuning may then be adjustable by the user, adjustable by a technician when the luminaire is installed or subsequently, or preset by the manufacturer.

There are at least two possible ways auxiliary red and/or blue LEDs can be provided. The first is to put one or more red or other auxiliary LEDs in the same plane as the primary blue LEDs. In order to produce an output beam of uniform color without additional mixing, this typically requires that the collimating optics be able to homogenize the two colors such that the beam patterns on the phosphor are very similar. That can be accomplished by lenslets on the flat surface of the plano-convex lens 103 or 303. Many alternative collimator homogenizers are known to those skilled in the art of nonimaging optics.

A second way is to embed the auxiliary LEDs in the remote phosphor. If the phosphor color is only slightly too cool, the amount of red light needed to make white is relatively low, so this approach would not add a significant load on the rear heat sink loads. In the case of a discontinuous phosphor, the red LEDs can be placed in the gaps in the phosphor.

As an example of possible performance, the values shown in Table 1 are estimates for a system as described above, showing the electrical power apportioned to the auxiliary blue (490 nm) and red (625 nm) LEDs as a fraction of each electrical Watt, with the balance to the primary blue (440 nm) LEDs. The driver power supply is assumed to have 92% efficiency in converting incoming electrical power to DC to supply the LEDs. The primary reflector has a reflectivity of 92%, other surfaces have a reflectivity of 98%. The primary blue LEDs have a radiant efficiency of 40% at 250 mA per 1 $mm^2$ chip, and the phosphor has a quantum efficiency of 85%. The characteristics assumed for the phosphor are based on the UBV_Y02 high efficacy yellow phosphor from PhosphorTech Corporation, of Lithia Springs, Ga.

The blue reflectivity values represent 10% Fresnel reflection at the front surface of the phosphor, with the balance from blue light that passes through the phosphor unconverted. The total blue reflectance thus depends on the thickness of the phosphor, and four different thicknesses are shown. For each combination of lighting, the x and y chromaticity coordinates, correlated color temperature (CCT) in Kelvin, color rendering index (CRI), lumens per Watt (LPW) including all losses, and heat generated at the phosphor as a fraction of total system power consumption are shown.

The values shown in Table 1 are believed to be achievable with luminaires as described above, using materials and components already commercially available.

TABLE 1

| | Blue Refl | Aux Blue | Red | x | y | CCT | CRI | LPW | Phos Heat |
|---|---|---|---|---|---|---|---|---|---|
| 1 | 28% | 0 | 0 | 0.296 | 0.326 | 7700 | 74 | 88 | 0.0819 |
| 2 | 28% | 0.1 | 0.15 | 0.353 | 0.339 | 4500 | 91 | 66 | 0.0670 |
| 3 | 28% | 0.1 | 0.2 | 0.371 | 0.338 | 4000 | 91 | 62 | 0.0629 |
| 4 | 24% | 0 | 0 | 0.308 | 0.355 | 6500 | 70 | 93 | 0.0865 |
| 5 | 24% | 0 | 0.1 | 0.344 | 0.351 | 4800 | 83 | 80 | 0.0778 |
| 6 | 24% | 0.1 | 0.1 | 0.347 | 0.365 | 4900 | 86 | 74 | 0.075 |
| 7 | 24% | 0.2 | 0.2 | 0.387 | 0.375 | 4000 | 90 | 59 | 0.0636 |
| 8 | 21% | 0 | 0 | 0.318 | 0.378 | 5950 | 65 | 96 | 0.09 |
| 9 | 21% | 0.1 | 0.1 | 0.357 | 0.385 | 4800 | 82 | 76 | 0.0780 |
| 10 | 21% | 0.1 | 0.15 | 0.375 | 0.381 | 4200 | 86 | 71 | 0.0735 |
| 11 | 21% | 0.1 | 0.25 | 0.409 | 0.362 | 3200 | 80 | 68 | 0.067424 |
| 12 | 16% | 0 | 0 | 0.337 | 0.420 | 5300 | 53 | 102 | 0.0956 |
| 13 | 16% | 0.05 | 0.1 | 0.377 | 0.422 | 4300 | 71 | 85 | 0.0855 |
| 14 | 16% | 0.05 | 0.2 | 0.412 | 0.410 | 3600 | 76 | 73 | 0.0830 |
| 15 | 16% | 0 | 0.25 | 0.428 | 0.399 | 3100 | 73 | 71 | 0.0726 |

Line 6, for a 25 W downlight with 24 primary blue LEDs, 3 auxiliary blue LEDs, and 3 red LEDs each running nominally at 0.75 W, allowing 2.5 W upward margin for tuning of the CCT and/or CRI, and line 10, with 24 primary blue LEDs, 2 auxiliary blue LEDs, and 4 red LEDs, are believed to be of practical interest.

If it is desired that the optical system be reduced in size, the LED collimator can be designed as described in commonly-assigned U.S. Patent Application publication No. 2008-0291682 by Falicoff et al. for "LED Luminance-Augmentation via Specular Retroreflection, Including Collimators that Escape the Etendue Limit" filed May 21, 2008, which is incorporated herein by reference in its entirety. That application reveals how collimators can be designed with a reduced diameter to escape the traditional etendue limit. That enables the LED collimator to be located closer to the phosphor, significantly reducing the overall size of the luminaire.

The preceding description of the presently contemplated best mode of practicing the invention is not to be taken in a limiting sense, but is made merely for the purpose of describing the general principles of the invention. The full scope of the invention should be determined with reference to the Claims.

Although various embodiments have been described, the skilled reader will understand how features of different embodiments may be combined in a single luminaire.

We claim:

1. A luminaire comprising:
- one or more blue LED chips;
- a collimator operative on the emitted light of said chips to produce collimated light;
- a phosphor situated at a distance from said LED chips such that said collimated light illuminates said phosphor; and
- a beam-forming reflector surrounding said phosphor and arranged to produce an output beam of light from the phosphor past the LED chips.

2. The luminaire of claim 1, wherein the beam-forming reflector produces said output beam centered on an axis from a center of the phosphor through a center of the LED chips.

3. A luminaire comprising:
- a housing with an open end and a closed end;
- a phosphor patch in the closed end of the housing;
- a light source spaced from the phosphor patch in the direction from the closed end of the housing to the open end of the housing, and arranged to emit light so as to illuminate said phosphor patch;
- wherein light from said phosphor patch is emitted through the open end of the housing past the light source.

4. The luminaire of claim 3, further comprising a collimator operative on the output light of said light source such that said collimator illuminates said phosphor patch with light from said light source.

5. The luminaire of claim 3, further comprising a beam-forming reflector surrounding said phosphor patch to form a beam of said light from said phosphor patch emitted through the open end of the housing.

6. The luminaire of claim 3, further comprising an opaque reflector behind said phosphor patch at the closed end of the housing.

7. The luminaire of claim 3, wherein the light source comprises at least one blue LED.

8. The luminaire of claim 7, wherein the emitted light comprises blue light from the blue LED reflected at the phosphor patch and light produced by conversion of the blue light from the blue LED by the phosphor patch.

9. The luminaire of claim 8, wherein the emitted light is white.

10. A luminaire comprising:
- a shroud having an open end and a closed end;
- an opaque reflector in the closed end of the shroud;

a phosphor patch in the closed end of the shroud, between the opaque reflector and the closed end of the shroud;

a light source in the open end of the shroud, operative to direct onto the phosphor patch light of a frequency effective to excite the phosphor patch;

wherein light from the phosphor patch exits through the open end of the shroud past the light source.

11. The luminaire of claim 10, further comprising a primary reflector between the phosphor patch and the open end of the shroud can arranged to form light from the phosphor patch into a beam exiting through the open end of the shroud.

12. The luminaire of claim 10, wherein the primary reflector comprises a conicoidal reflector having a narrow end encircling the phosphor patch.

13. The luminaire of claim 12, wherein the primary reflector further comprises a cylindrical reflector extending from a wide end of the conicoidal reflector to the open end of the can.

14. The luminaire of claim 13, wherein said light source comprises a collimator for said light directed onto said phosphor patch.

15. The luminaire of claim 14, further comprising an inner cylinder surrounding said collimating apparatus, the exterior of said cylinder coated as to function as a specular mirror.

16. The luminaire of claim 10, wherein said light source comprises at least one blue LED chip.

17. The luminaire of claim 16, wherein said at least one LED chip is cooled by a heat sink situated on a side of said at least one LED chip opposite from a side to which said LED chip emits light.

18. The luminaire of claim 10, wherein said phosphor patch is cooled by a heat sink situated on the opposite side of said opaque reflector from a side facing said light source.

19. The luminaire of claim 10, further comprising one or more red LED chips.

20. The luminaire of claim 10, which has a tunable color temperature.

* * * * *